US005345961A

United States Patent [19]

Yercha et al.

[11] Patent Number: 5,345,961

[45] Date of Patent: Sep. 13, 1994

[54] TOY CARDBOARD TENT

[75] Inventors: N. Wayne Yercha; Desmond W. Dennis, both of Victoria, Canada

[73] Assignee: Dino Pal Toys Ltd., Victoria

[21] Appl. No.: 133,515

[22] Filed: Oct. 7, 1993

[51] Int. Cl.[5] ..... E04H 15/00

[52] U.S. Cl. ..... 435/87; 135/106; 135/900; 229/198.2; 446/478; 446/488

[58] Field of Search ..... 135/100, 87, 94, 117, 135/900, 902, 91, 93, 106, 112; 229/162, 115, 120, 198.2, 125.17, 125.28; 446/488, 478, 80

[56] References Cited

U.S. PATENT DOCUMENTS

| | | | |
|---|---|---|---|
| 928,423 | 7/1909 | Belson | 229/115 |
| 1,361,886 | 12/1920 | Martinsen | 446/488 X |
| 2,084,106 | 6/1937 | Palmer et al. | 229/115 X |
| 2,232,953 | 2/1941 | Mallgraf | 446/488 X |
| 2,985,353 | 5/1961 | Force | 229/115 X |
| 3,428,235 | 2/1969 | Randazzo | 229/115 X |
| 4,770,339 | 9/1988 | Weimer | 229/120 X |

FOREIGN PATENT DOCUMENTS 2262539 7/1974 Fed. Rep. of Germany ..... 229/120

*Primary Examiner*—Carl A. Friedman
*Assistant Examiner*—Lan C. Mai
*Attorney, Agent, or Firm*—Charles J. Prescott

[57] ABSTRACT

A toy cardboard tent deployable from a flat, stored configuration including two identically shaped side panels which are integrally connected along a central longitudinal fold line therebetween and a triangular shaped flat back panel. The back panel is securable as by a locking tab and slot arrangement to an upright rear end margin of each side panel. Each side panel preferably includes indicia printed thereon, identical on each side panel, which depicts an animal figure such as a dinosaur or other fanciful figure positioned on each side panel so as to be facing toward a distal upright front end margin of each side panel. Each front end margin is contoured to conform to the forwardly facing profile of the animal or fanciful figure. Peep flaps, vent holes, and a pair of window flaps are also provided.

9 Claims, 3 Drawing Sheets

TOY CARDBOARD TENT

BACKGROUND OF THE INVENTION

1. Scope of Invention

This invention relates generally to tent structures, and more particularly to a toy corrugated cardboard tent which is deployable from a flat folded stored configuration and having indicia and cooperatively contoured front opening structure so as to depict the shape of an animal on each side panel thereof.

2. Prior Art

A-shaped tents are well known. These such tents are available in conventional canvas form and deployable over a separate rigid support structure. Such tents also typically require additional ropes securable into ground for their support.

The present invention provides a toy cardboard tent easily deployable by children for playing therein. The invention is generally A-shaped and self supposing, being fabricated of conventional stiff cardboard material or the like. The sloping sides of the device include printed indicia thereon, identical side-to-side, which depicts a large animal such as a dinosaur, a small animal such as a rabbit, a fanciful angle, a vehicle, or the like thereon. The frontal profile of the animal or similar indicia is coincident with the contoured forward edges of the side panels which define the open end of the device, the back end thereof being enclosed by a triangular cardboard back panel.

BRIEF SUMMARY OF THE INVENTION

This invention is directed to a toy cardboard tent, deployable from a flat, stored configuration, including to identically shaped side panels which are integrally connected along a central longitudinal fold line therebetween and a triangular shaped flat back panel. The back panel is securable as by a locking tab and slot arrangement to an upright rear end margin of each side panel. At least one, and preferably each side panel includes indicia printed thereon, identical on each side panel, which depicts an animal figure such as a dinosaur positioned on each side panel so as to be facing toward a distal upright front end margin of each side panel. Each front end margin is contoured to conform to the forwardly facing profile of the animal figure. Peep flaps, vent holes, and a pair of window flaps are also provided.

It is therefore an object of this invention to provide a toy cardboard tent for children which simulates the appearance of a large animal, or other similar indicia.

It is yet another object of this invention to provide a toy cardboard tent which is easily deployable by children and self supporting when erected.

It is yet another object of this invention to provide a toy cardboard tent which is easily storable in a flat folded configuration when not in use or during shipment or storage.

It is yet another object of this invention to provide an inexpensive toy cardboard tent which may be enjoyed by a broad range of children regardless of economic status because of its economical construction and ease of shipment in-the-flat.

In accordance with these and other objects which will become apparent hereinafter, the instant invention will now be described with reference to the accompanying drawings.

DETAILED DESCRIPTION OF THE INVENTION

Figure 1:
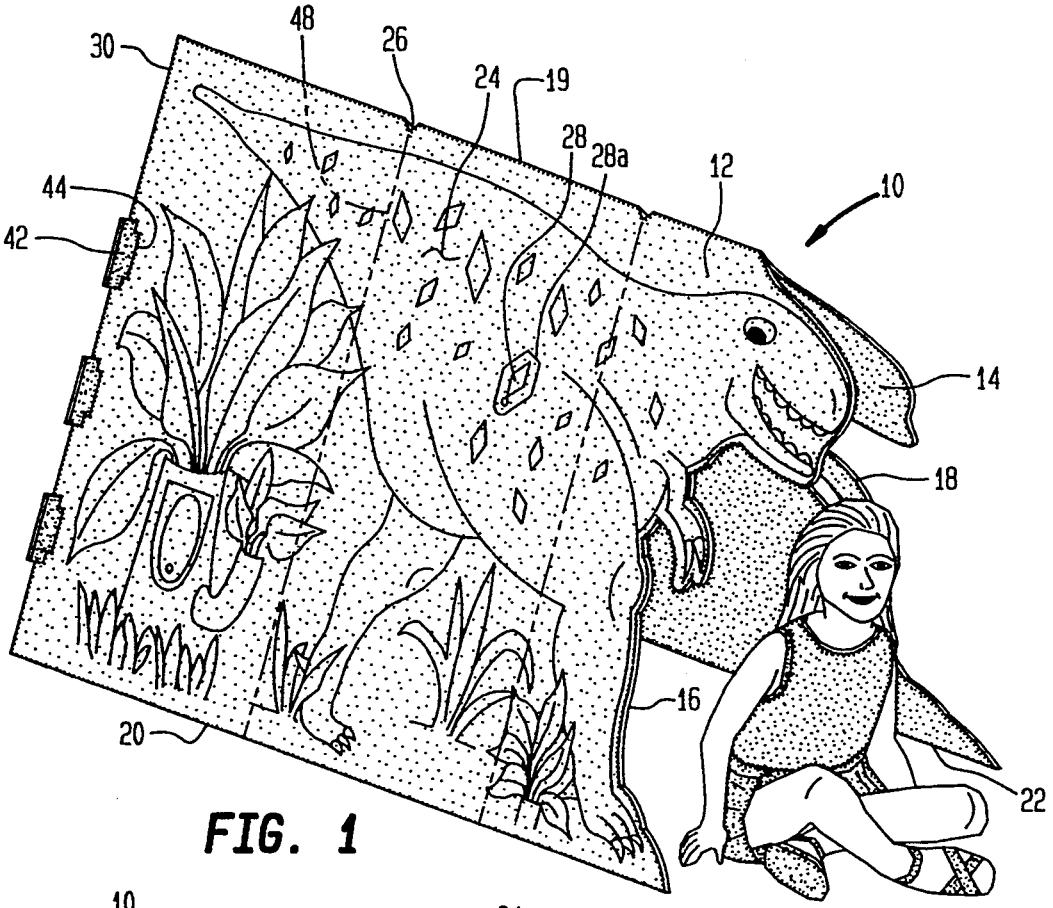
FIG. 1 is a perspective view of one embodiment of the invention as deployed.
Figure 2:
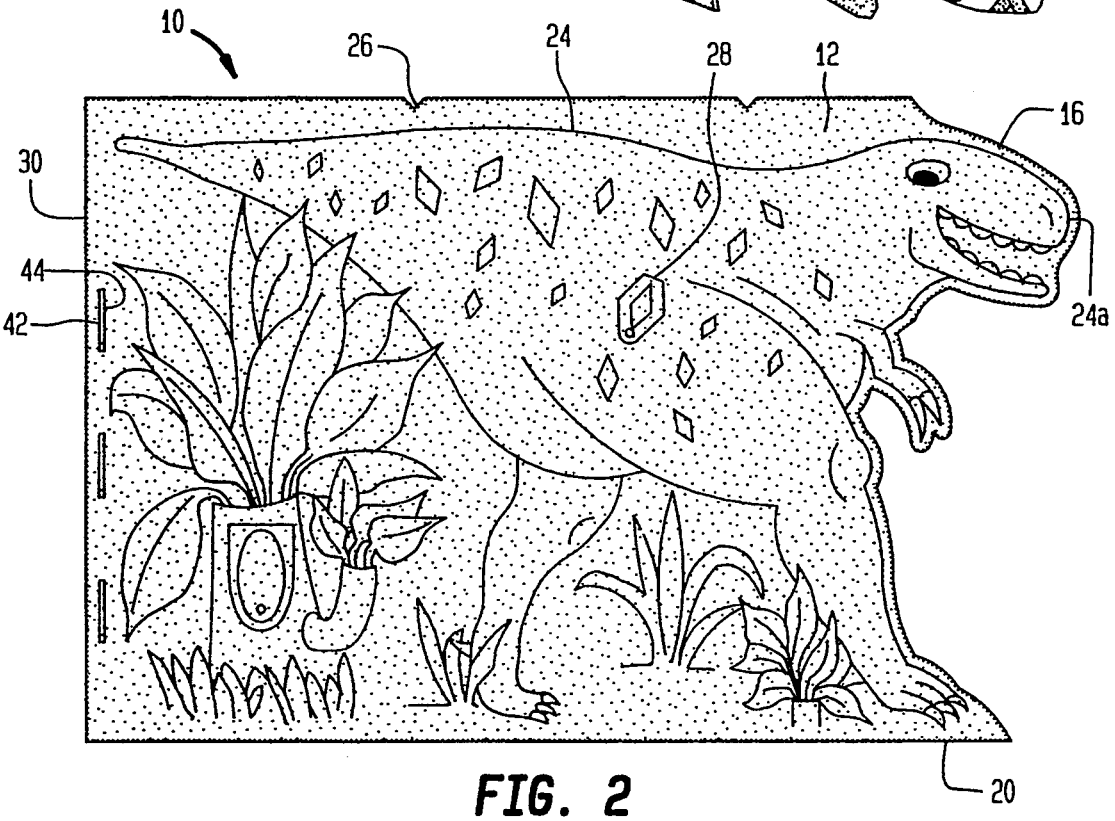
FIG. 2 is a side view of FIG. 1 orthogonal to the side panel thereof in the direction of arrows 2—2 in FIG. 3.
Figure 3:
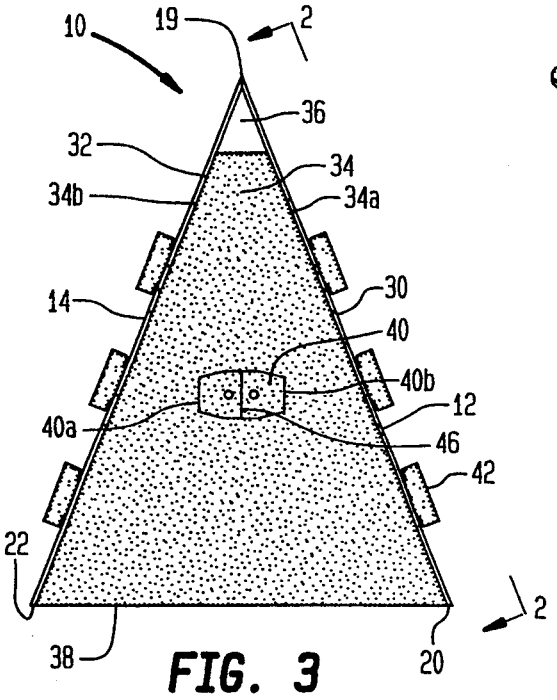
FIG. 3 is an end elevation view of FIG. 1.

Referring now to FIGS. 1 to 3, one embodiment of the invention is shown generally at numeral 10 and includes a pair of side panels 12 and 14 fabricated of stiff, flat cardboard material and integrally connected along a central longitudinal upper fold line 19. The lower margins 20 and 22 are generally parallel to the upper longitudinal fold line 19 and rest directly atop a horizontal support surface such as the ground or a floor so that the bottom of the toy tent 10 is open.

A triangularly shaped back panel 34, also formed of flat, stiff cardboard material, includes T-shaped tabs 42 along each sloping side margin **34*a* and 34*b* thereof. These locking tabs 42 lockably engage into mating slots 44 (typ.) formed along each upright rear end margin 30 and 32 of each side panel 12 and 14. When so deployed, the back panel 34 serves to render the toy tent 10** completely self-supporting, aided by the stiff nature of the cardboard material forming each of the components thereof.

Printed on at least one, and preferably both, side panels 12 and 14 is indicia 24 which depicts a large animal such as a dinosaur, along with other decorative artwork such as vegetation. The animal FIG. 24 is generally sized similar to that of each side panel 12 and 14 and has a facing or frontal profile **24*a* which closely corresponds to a distal upright front margin 16 and 18 of each side panel 12 and 14. No additional front panel structure is required. By this arrangement, a child playing with the toy tent 10 as shown in FIG. 1 enjoys the feeling of playing within the confines of a simulated animal 24 and also enjoys the benefit of viewing the device 10 from outside thereof as though viewing a large simulated animal 24** of a size similar to that of the child.

Formed by cutting, one or more peep flaps 28 (typ.) are also provided within one or both side panels 12 and 14. These peep flaps 28 are hingedly connected along one integral fold line **28*a* so that they may be flipped out of the plane of each side panel 12 or 14 for viewing therethrough and, when closed, are inconspicuously blended within the animal figure indicia 24. Because of the cut construction of each peep flap 28, they fit tightly within the plane of the side panels 12 and 14** when closed.

Vents 26 are also provided along longitudinal fold line 19 which may also serve to facilitate folding the device 10 along fold lines 48 (typ.) during storage and shipment.

The back panel 34 also includes a pair of window flaps 40 (typ.) which are foldable from a closed to an open position about fold lines 40*a* and 40*h*, formed by a generally H-shaped cut, horizontally oriented, in a central portion of the back panel 34. By this arrangement, each of the window flaps 40 are openable about a central upright slit 46 therebetween.

Figure 4:
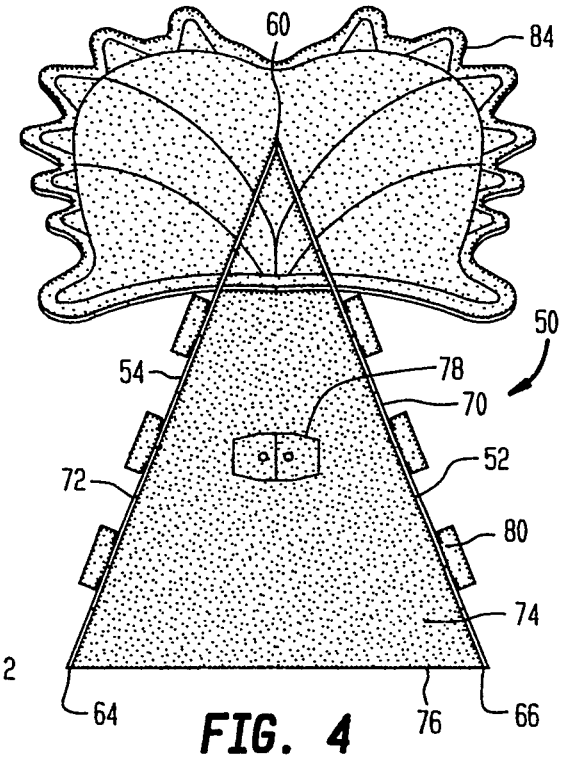
FIG. 4 is an end elevation view of another embodiment of the invention.
Figure 5:
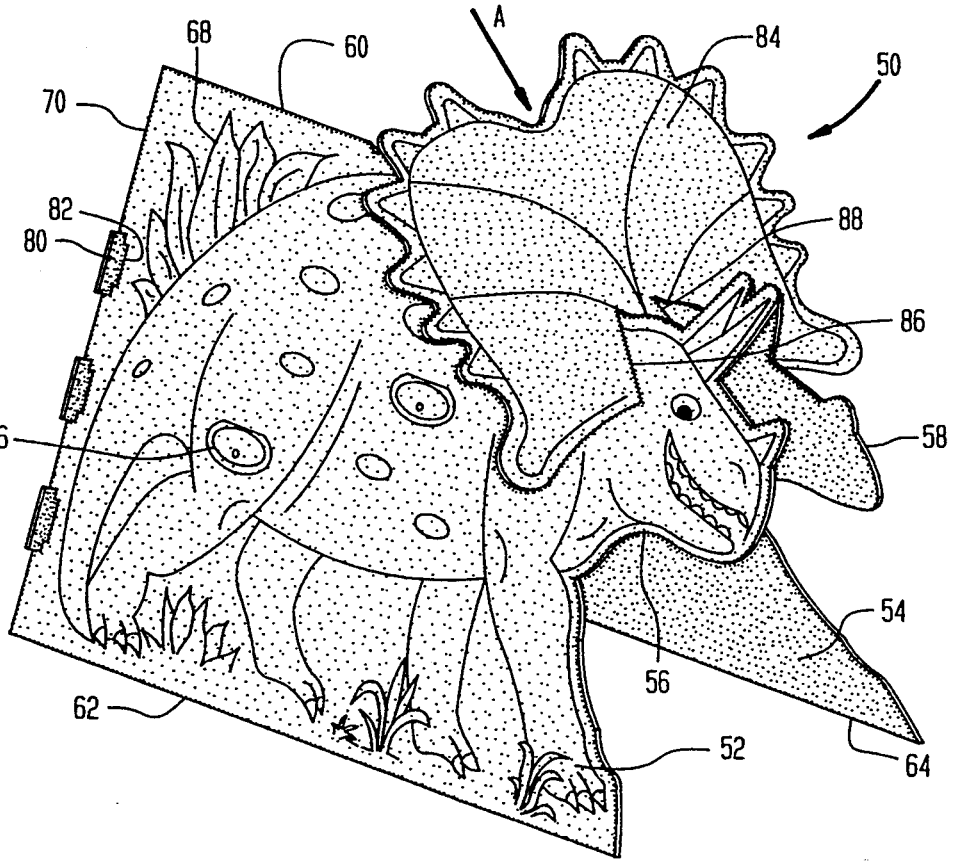
FIG. 5 is a perspective view of another embodiment of the invention.
Figure 6:
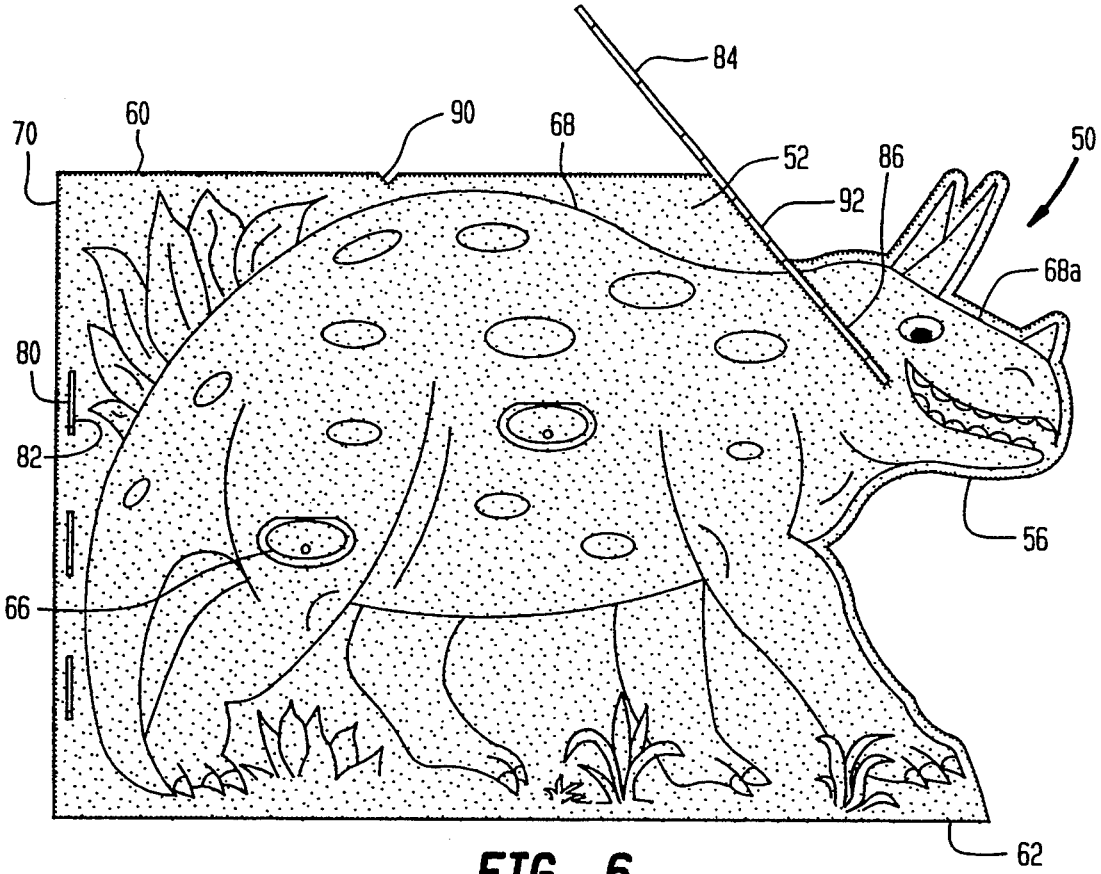
FIG. 6 is a side view of FIG. 5 orthogonal to the side panel thereof similar to that of FIG. 2.

Referring now to FIGS. 4, 5, and 6, another embodiment of the invention is there shown generally at numeral 50. This embodiment 50 also includes side panels 52 and 54 which are fabricated of stiff cardboard and are integrally connected along a fold line 60 which forms a longitudinal apex of the toy tent 50 when deployed.

Printed indicia 68 in the form of another dinosaur or other large animal is printed preferably on an outer surface of each side panel 52 and 54. Again, the frontal or facing profile 68*a* of the animal FIG. 68 is closely aligned and follows a distal contour of the front end margin 56 and 58 of each of the side panels 52 and 54.

A triangular stiff cardboard upright back panel 74, in combination with its T-shaped tabs 80, serve to establish the A-shaped tent configuration when interconnected within mating slots 82 along the upright back margin 70 and 72 of each of the side panels 52 and 54. A pair of windows 78 (typ.) are also formed into the back panel 74 as previously described.

The toy tent 50 is self-supporting along lower margins 62 and 64 which define an open bottom of the device 50. No additional structure is required to define the open front ended toy tent 50 when erected.

In this embodiment 50, an additional flat, stiff cardboard panel 84 is also provided which simulates a mane or a bony frill of the animal FIG. 68. The mane panel 84 includes a profile which accomplishes the desired descriptive aspects of the animal figure's mane. Mating slots 86 and 88 are cooperatively formed in the mane panel 84 diagonally upwardly extending from a lower margin thereof and downwardly extending into the side panels 52 and 54 at a portion of the distal front margins 56 and 58 just behind the simulated head of the animal FIG. 68. These cooperative slots 86 and 88 allow the simulated mane 84 to be downwardly inserted in the direction of arrow A and be to supported in that position when deployed. Vent notches 90 and two peep slots 66 per side are also provided as previously described.

Figure 7:
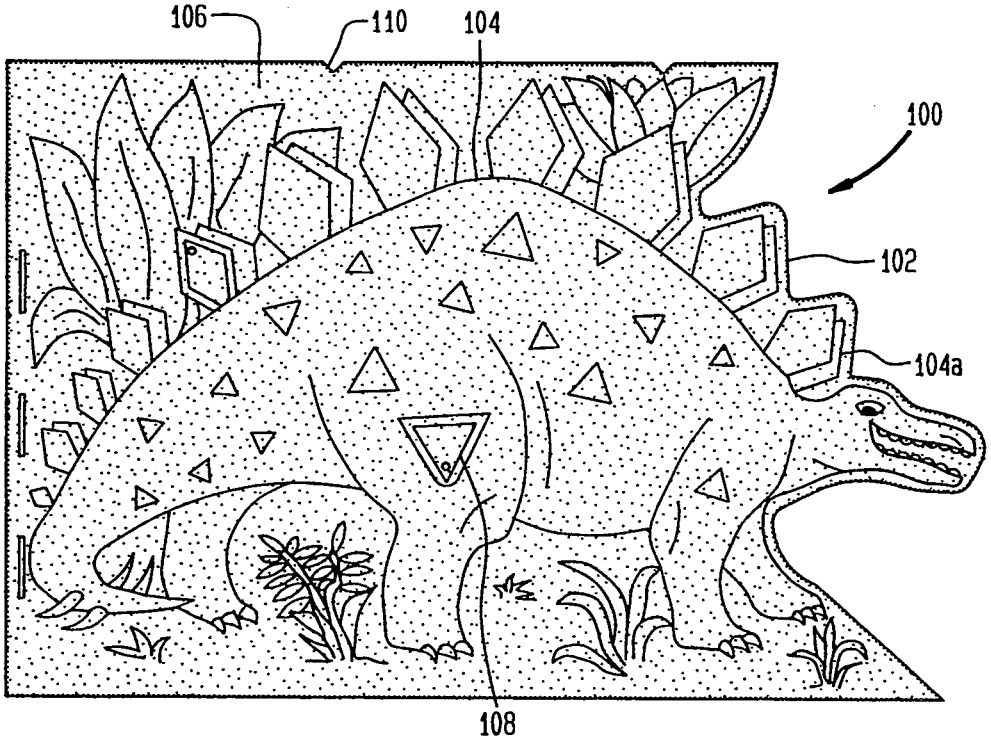
FIG. 7 is a view similar to FIG. 6 of yet another embodiment of the invention.

To show the versatility of the present invention, another embodiment is shown in FIG. 7 generally at numeral 100 and depicts yet another printed indicia 104 of yet another animal figure. Again, the preferred embodiment of the animal FIG. 104 is in the form of a dinosaur having a size generally similar to that of the entire side panel 106. As previously described, the forwardly facing or frontal profile 104*a* of the animal FIG. 104 closely conforms with the distal forward margin 102 of the side panel 106. A vent 110, a peep flap 108 and a triangular back panel (not shown) are also provided as previously described.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A toy cardboard tent deployable from a flat, stored configuration comprising:

a pair of flat side panels each having identical edge profiles one to another and hingedly connected along a straight upper longitudinal fold line therebetween;

each said side panel having a straight lower distal margin which is generally parallel to said upper fold line;

a triangular shaped flat back panel releasably connectable by a T-shaped locking tab and slot arrangement along each sloping side margin of said back panel between an upright rear end margin of each said side panel wherein said side panels are sloping downwardly from said upper fold line at an acute angle equal to that of said side margin of said back panel;

indicia printed on an outer surface of at least one said side panel depicting an animal figure on each said outer surface, said animal figure facing toward a distal upright front end margin of each said side panel to define an open entrance to said tent;

each said front end margin contoured identically one to another to conform to a forwardly facing profile of said animal figure.

2. A toy cardboard tent as set forth in claim 1, further comprising:

a peep flap formed through each said side panel and hingedly connected to said side panel along a peep flap fold line, said peep flap being continuous with said side surface when in a closed position.

3. A toy cardboard tent as set forth in claim 2, further comprising:

a vent hole formed into said longitudinal fold line in a form of a V-shaped notch.

4. A toy cardboard tent as set forth in claim 3, further comprising:

a pair of window flaps each formed centrally through said back panel by a generally H-shaped cut through said back panel;

each said window flap hingedly connected along a fold line at each end of said H-shaped cut;

said pair of window flaps being continuous with said back panel when in a closed position.

5. A toy cardboard tent as set forth in claim 1, further comprising:

a simulated body frill of said animal figure formed of a flat panel having two first slots formed and diagonally extending upwardly from a lower margin thereof;

a second slot formed and diagonally extending downwardly from an upper point of each said front end margin in the region of a head area of said animal figure;

said first and second slots matingly engagable by downward movement of said bony frill into said second slots to support said simulated bony frill in position by said side panels.

6. A toy cardboard tent deployable from a flat, stored configuration comprising:

a pair of flat side panels each having identical edge profiles one to another and hingedly connected along a straight upper longitudinal fold line therebetween;

each said side panel having a straight lower distal margin which is generally parallel to said upper fold line;

a triangular shaped flat back panel releasably connectable by a T-shaped locking tab and slot arrangement along each sloping side margin of said back panel between an upright rear end margin of each said side panel wherein said side panels are sloping downwardly from said upper fold line at an acute angle equal to that of said side margin of said back panel;

indicia printed on an outer surface of at least one said side panel depicting an fanciful figure on each said outer surface, said fanciful figure facing toward a distal upright front end margin of each said side panel to define an open entrance to said tent;

each said front end margin contoured identically one to another to conform to a forwardly facing profile of said fanciful figure.

7. A toy cardboard tent as set forth in claim 6, further comprising:

a peep flap formed through each said side panel and hingedly connected to said side panel along a peep flap fold line, said peep flap being continuous with said side surface when in a closed position.

8. A toy cardboard tent as set forth in claim 7, further comprising:

a vent hole formed into said longitudinal fold line in a form of a V-shaped notch.

9. A toy cardboard tent as set forth in claim 8, further comprising:

a pair of window flaps each formed centrally through said back panel by a generally H-shaped cut through said back panel;

each said window flap hingedly connected along a fold line at each end of said H-shaped cut;

said pair of window flaps being continuous with said back panel when in a closed position.

* * * * *